US005094812A

United States Patent [19]

Dulmaine et al.

[11] Patent Number: 5,094,812

[45] Date of Patent: Mar. 10, 1992

[54] AUSTENITIC, NON-MAGNETIC, STAINLESS STEEL ALLOY

[75] Inventors: Bradford A. Dulmaine, Muhlenberg Township; Theodore Kosa, Cumru Township; John H. Magee, Jr., Exeter Township; Donald K. Schlosser, Shillington, all of Pa.

[73] Assignee: Carpenter Technology Corporation, Reading, Pa.

[21] Appl. No.: 508,222

[22] Filed: Apr. 12, 1990

[51] Int. Cl.[5] ..... C22C 38/38

[52] U.S. Cl. ..... 420/57; 420/59

[58] Field of Search ..... 420/57, 59

[56] References Cited

U.S. PATENT DOCUMENTS 567,918 12/1858 Jackson et al. ..... 420/57

4,523,951 6/1985 Andreini et al. ..... 420/57

*Primary Examiner*—Deborah Yee

*Attorney, Agent, or Firm*—Dann, Dorfman, Herrell and Skillman

[57] ABSTRACT

An austenitic, non-magnetic, stainless steel alloy and articles made therefrom are disclosed which, in the wrought condition, are essentially ferrite-free and have a relative magnetic permeability of less than about 1.02, a room temperature 0.2% yield strength of at least about 100 ksi, and good resistance to stress corrosion cracking in chloride environments. Broad, intermediate, and preferred ranges are disclosed as follows:

| | w/o | | |
|---|---|---|---|
| | Broad | Intermediate | Preferred |
| C | 0.08 max. | 0.05 max. | 0.035 max. |
| Mn | 14–19 | 15–18 | 16–18 |
| Si | 1 max. | 1 max. | 0.75 max. |
| Cr | 12–21 | 14–19.5 | 16–18 |
| Ni | 3.5 | 2.5 max. | 1.5 max. |
| Mo | 0.5–4 | 0.75–2.5 | 1.0–2.0 |
| Cu | 2.0 max. | 1.5 max. | 1.0 max. |
| N | 0.2–0.8 | 0.3–0.7 | 0.4–0.6 |
| B | 0.06 max. | 0.005 max. | 0.005 max. |

the balance being iron. The alloy is balanced to be essentially ferrite-free and is further balanced according to Equations 1 and 2 (Eqs. 1 and 2) to provide good chloride SCC resistance:

$$W/o\ \mathrm{Ni} + 2(w/o\ \mathrm{Cu}) \leqq \frac{W/o\ \mathrm{Cr} + w/o\ \mathrm{Mo} - 14.6}{1.5} \quad \text{(Eq. 1)}$$

$$\mathrm{w/o\ Mn} < \mathrm{w/o\ Cr} + \mathrm{w/o\ Mo} \quad \text{(Eq. 2)}$$

22 Claims, No Drawings

AUSTENITIC, NON-MAGNETIC, STAINLESS STEEL ALLOY

BACKGROUND OF THE INVENTION

This invention relates to an austenitic, non-magnetic, stainless steel alloy and articles made therefrom and, more particularly, to such an alloy which, when significantly warm-worked but not subsequently annealed, has an outstanding combination of non-magnetic behavior, high yield strength, and good corrosion resistance, particularly resistance to chloride stress corrosion cracking.

Chromium-manganese stainless steel alloys are used in the manufacture of oilwell drilling equipment, including certain kinds of drill collars and housings for measurement-while-drilling (MWD) assemblies. More specifically, modern deep-well drilling methods, including directional drilling, require close monitoring of the location of the borehole to minimize deviations from the desired course. This may be accomplished by incorporating electrical measuring equipment in certain drill collar sections. However, since such measurements are disturbed by magnetic behavior, those drill collars containing such equipment must be non-magnetic, meaning here and throughout this application, having a relative magnetic permeability of less than about 1.02. Also, drill collars and other such articles are required to have high strength, particularly, a room temperature 0.2% offset yield strength of at least about 100 ksi. Chromium-manganese stainless steels have been favored in the manufacture of such articles because they satisfy both of these requirements at reasonable cost.

The following are hitherto known chromium-manganese stainless steel alloys, the compositions of which are listed in Table I: UNS S28200; UNS S21300; the experimental alloy described in V. Cihal and P. Pohoril, "Austenitic Chromium-Manganese Steels Resistant to SCC in Concentrated Chloride Solutions" in *Stress Corrosion Cracking and Hydrogen Embrittlement of Iron Base Alloys,* 1170–1182, NACE (1977), identified here as Heat No. 7412; U.S. Pat. No. 3,075,839, issued to E. J. Dulis et al. on Jan. 29, 1963; U.S. Pat. No. 3,112,195, issued to H. Souresny on Nov. 26, 1963; U.S. Pat. No. 3,904,401, issued to D. L. Mertz et al. on Sept. 9, 1975 (UNS S28200 and UNS S21300 are both exemplary alloys of this patent); U.S. Pat. No. 4,514,236, issued to W. T. Cook et al. on Apr. 30, 1985; U.S. Pat. No. 4,523,951, issued to R. J. Andreini et al. on June 18, 1985; Duvall XM-19H; and U.S. Pat. No. 4,481,033, issued to K. Fujiwara et al. on Nov. 6, 1984. The foregoing alloys suffer from one or more deficiencies. For example, UNS S28201 and UNS S21300 (representative of the 3,904,401 patent) have less than desirable stress corrosion cracking (SCC) resistance. The alloy described by Cihal et al. contains excessive amounts of ferrite, causing undesirable magnetic behavior. Further, the balance of elements in these alloys reflects a lack of recognition of the important relationship between the manganese and the nickel and copper contents of the alloy on the one hand, and the chromium plus molybdenum contents on the other hand, in ensuring good resistance to SCC in chromium-manganese stainless steel alloys.

TABLE I

| | w/o | | | | | | | | | |
|---|---|---|---|---|---|---|---|---|---|---|
| | UNS S28200 | UNS S21300 | Cihal 7412 | '839 | '195 | '401 | '236 | '951 | Duvall XM-19H | '033 |
| C | 0.15 max. | 0.25 max. | 0.05 | 0.15 max. | 0.01–0.25 | 0.25 max. | 0.50 max. | 0.035 max. | 0.046 | 0.05–0.18 |
| Mn | 17–19 | 15–18 | 15.49 | 11–14 | 12.00–25.00 | 15–20 | 10–25 | 16–20 | 18.57 | 16–25 |
| Si | 1 max. | 1 max. | 0.49 | 0–3 | 0.10–1.00 | 0–1 | 1 max. | | 0.73 | 0–1.0 |
| Cr | 17–19 | 16–21 | 19.22 | 14–18 | 10.00–20.00 | 16–22 | 0–20 | 12–15 | 11.98 | 14–17 |
| Ni | | 3 max. | 0.012 | 0.5 max. | 5.00 max. | 3 max. | 1 max. | 2.5 max. | 0.31 | 0.06–0.3 |
| Mo | 0.5–1.5 | 0.5–3 | 0.524 | 0.3–3 | 1.00 max. | 0.5–3 | 1.0 max. | 5 max. | 1.15 | |
| Cu | 0.5–1.5 | 0.5–2 | | 2 max. | | 0.5–2 | | | 0.03 | |
| N | 0.4–0.6 | 0.2–0.8 | 0.364 | 0.15–0.55 | 0.05–0.50 | 0.2–0.8 | 0.20 min. | 0.2–0.5 | 0.38 | 0.3–0.6 |
| B | | | | | | 0.01 max. | | | | |
| P | 0.045 max. | 0.05 max. | 0.020 | 0.04 max. | | 0.05 max. | 0.10 max. | | 0.022 | |
| S | 0.030 max. | 0.5 max. | 0.009 | 0.04 max. | | 0.5 max. | 0.10 max. | | | |
| Se | | | | | | 0.75 max. | | | | |
| V | | | | | | | 0.2–2.0 | | 0.05 | 0.8 max. |
| Nb | | | | | | | 0.1 max. | * | | |
| Fe | Bal. | Bal. | Bal. | Bal. | Bal. | Bal. | Bal. | Bal. | Bal. | Bal. |

*w/o Nb ≧ 10 w/o C

Recent developments in deep-well drilling methods have placed more stringent demands on parts such as drill collars. For instance, such parts are required to operate in increasingly severe chloride environments, for example, in contact with drilling muds containing high concentrations of chlorides, leading to increased risk of costly premature failure due to chloride stress corrosion cracking. Thus, a significant problem encountered by the oil drilling industry is that drill collars used to house critical measurement-while-drilling equipment, fabricated from known chromium-manganese stainless steel alloys, do not possess the requisite combination of non-magnetic behavior, high yield strength and good resistance to chloride stress corrosion cracking necessary for acceptable performance under more exacting operating conditions.

SUMMARY OF THE INVENTION

It is, therefore, a principal object of this invention to provide an austenitic, non-magnetic, stainless steel alloy which, when warm-worked utilizing conventional techniques, but not subsequently annealed, provides an outstanding combination of properties including non-magnetic behavior, high yield strength, and good corrosion resistance, particularly resistance to chloride stress corrosion cracking.

It is a further object of this invention to provide articles made of such an austenitic, non-magnetic, stainless steel alloy which, when warm-worked but not subsequently annealed, have an outstanding combination of non-magnetic behavior, high yield strength and good corrosion resistance, particularly resistance to chloride stress corrosion cracking.

A more specific object of this invention is to provide such an austenitic, non-magnetic, stainless steel alloy and articles made therefrom which, when warm-worked but not subsequently annealed, are essentially ferrite-free and have a relative magnetic permeability of less than about 1.02, a room temperature 0.2% offset yield strength of at least about 100 ksi, and, which are characterized by improved resistance to stress corrosion cracking so that when tested under a stress of 50% of yield strength but not less than about 60 ksi in a boiling, saturated, aqueous, sodium chloride solution containing about 2.5 w/o ammonium bisulfite, do not fracture because of stress corrosion cracking in less than about 400 hours.

The foregoing objects and advantages of the present invention are largely attained by providing an austenitic, non-magnetic, stainless steel alloy as indicated in the broad range in Table II.

TABLE II

| | w/o | | |
|---|---|---|---|
| | Broad | Intermediate | Preferred |
| C | 0.08 max. | 0.05 max. | 0.035 max. |
| Mn | 14–19 | 15–18 | 16–18 |
| Si | 1 max. | 1 max. | 0.75 max. |
| Cr | 12–21 | 14–19.5 | 16–18 |
| Ni | 3.5 max. | 2.5 max. | 1.5 max. |
| Mo | 0.5–4 | 0.75–2.5 | 1.0–2.0 |
| Cu | 2.0 max. | 1.5 max. | 1.0 max. |
| N | 0.2–0.8 | 0.3–0.7 | 0.4–0.6 |
| B | 0.06 max. | 0.005 max. | 0.005 max. |

Further or additional advantages are obtained using the intermediate and preferred ranges in Table II. In order to achieve the good resistance to chloride stress corrosion cracking characteristic of this alloy, the alloy must be balanced to satisfy both Equation 1 (Eq. 1) and Equation 2 (Eq. 2):

$$W/o\ \mathrm{Ni} + 2(w/o\ \mathrm{Cu}) \leqq \frac{W/o\ \mathrm{Cr} + w/o\ \mathrm{Mo} - 14.6}{1.5} \quad \text{(Eq. 1)}$$

$$w/o\ \mathrm{Mn} < w/o\ \mathrm{Cr} + w/o\ \mathrm{Mo} \quad \text{(Eq. 2)}$$

Non-magnetic behavior is attained by balancing the alloy to be essentially ferrite-free. Here and throughout this application the term "essentially ferrite-free" and synonymous expressions mean that, in the as-cast condition, the alloy contains no more than about 5 volume percent (v/o) ferrite as determined by the point intercept method and that, in the wrought condition, the alloy contains less than about 0.5 v/o, better yet less than about 0.1 v/o, preferably no more than a trace of ferrite as determined by the point intercept method. For best results, no ferrite is detectable in the wrought alloy. Alternatively, the term "essentially ferrite-free" and synonymous expressions mean that the wrought alloy has a relative magnetic permeability of less than about 1.02 as measured using a Severn Gage. Articles made from the present alloy, when warm-worked but not subsequently annealed, have a unique combination of properties.

For all stated ranges and compositions, the balance of the alloy is essentially iron, except for incidental impurities and additions which do not detract from the desired properties. For example, up to about 0.05 w/o phosphorus, up to about 0.03 w/o sulfur and a combined amount of up to about 0.5 w/o niobium, titanium, vanadium, zirconium, hafnium and tungsten are tolerable in the alloy.

The foregoing tabulation is provided as a convenient summary and is not intended thereby to restrict the lower and upper values of the ranges of the individual elements of the alloy of this invention for use solely in combination with each other or to restrict the broad, intermediate, or preferred ranges of the elements for use solely in combination with each other. Thus, one or more of the broad, intermediate, and preferred ranges can be used with one or more of the other ranges for the remaining elements. In addition, a broad, intermediate, or preferred minimum or maximum for an element can be used with the maximum or minimum for that element from one of the remaining ranges. Throughout this application, unless otherwise indicated, all compositions in percent will be in percent by weight (w/o). Further objects and advantages of the present invention will be apparent from the following detailed description thereof.

DETAILED DESCRIPTION OF THE INVENTION

Although carbon is a strong austenite former and contributes to the tensile and yield strength of the present alloy, the presence of excessive carbon can undesirably sensitize the alloy, which can result in intergranular corrosion and chloride stress corrosion cracking. Sensitization of the microstructure occurs because of the precipitation of chromium-rich carbides at grain boundaries upon exposure of the alloy to certain elevated temperatures. Such sensitization is especially aggravated when the alloy is strained by warm-working at temperatures ranging from about 1000F. to about 1600F. (about 540–870C.), leading to accelerated SCC in chloride environments. Therefore, carbon is limited to no more than about 0.08 w/o, better yet to no more than about 0.05 w/o, and preferably to no more than about 0.035 w/o. Carbon and the remaining elements are carefully balanced to ensure the essentially ferrite-free composition of the alloy necessary to provide the desired non-magnetic behavior.

A minimum of about 0.2 w/o nitrogen is required to achieve the desired levels of yield strength and SCC resistance in the alloy and, because nitrogen is also a powerful austenite former, is particularly important in maintaining a compositional balance with the remaining elements which ensures the desired freedom from ferrite. Better yet at least about 0.3 w/o, preferably at least about 0.4 w/o nitrogen is present in the alloy. Increasing nitrogen above about 0.8 w/o objectionably detracts from the properties of the alloy because of excessive porosity. Better yet no more than about 0.7 w/o, preferably no more than about 0.6 w/o nitrogen is present.

Because it increases the solubility of nitrogen, the presence of manganese is necessary to permit use of the desired amount of nitrogen in the alloy. When the amount of manganese is too low, ingots having excessive porosity result. Thus, at least about 14 w/o manganese is present. Better yet at least about 15 w/o, better still more than 15 w/o, preferably at least about 16 w/o manganese is present. No more than about 19 w/o, preferably no more than about 18 w/o manganese is present in the alloy and, as described hereinbelow in Eq. 2, the alloy is balanced so that the amount of manganese is less than the combined amounts of chromium and molybdenum to maintain the desired level of SCC resistance.

Chromium contributes to the corrosion resistance of this alloy, especially resistance to chloride SCC. At least about 12 w/o, better yet at least about 14 w/o, preferably at least about 16 w/o chromium is present. Increasing chromium above about 21 w/o results in the presence of objectionable ferrite and therefore detracts from the non-magnetic behavior of the alloy. Better yet no more than about 19.5 w/o, preferably no more than about 18 w/o chromium is present in this alloy.

Molybdenum also enhances resistance of the alloy to both general corrosion and SCC. Therefore, the alloy contains at least about 0.5 w/o, better yet at least about 0.75 w/o, and preferably at least about 1.0 w/o molybdenum. Molybdenum, like chromium, is also a ferrite former and thus is limited to no more than about 4 w/o, better yet no more than about 2.5 w/o, preferably no more than about 2.0 w/o in order to ensure the desired essentially ferrite-free structure, and consequent non-magnetic behavior, of the alloy. As will be more fully pointed out below, chromium and molybdenum permit the presence of nickel and copper, both of which are highly deleterious to SCC resistance, at practical production levels.

Silicon is used to deoxidize the present alloy during melting. When present, silicon is limited to no more than about 1 w/o, preferably no more than about 0.75.

Nickel has a highly deleterious effect on the SCC resistance of this alloy. Nickel is limited to no more than about 3.5 w/o. The intermediate limit for nickel is no more than about 2.5 w/o, better yet no more than about 2.0 w/o, preferably no more than about 1.5 w/o, and most preferably no more than about 1.0 w/o is present.

Copper adversely affects the SCC resistance of the alloy to a greater extent than nickel and is therefore restricted to no more than about 2.0 w/o, better yet no more than about 1.5 w/o, preferably no more than about 1.0 w/o, and most preferably no more than about 0.3 w/o.

When added because of its beneficial effect on the hot workability of the alloy, no more than about 0.005 w/o boron is present. When improved machinability is desired, up to about 0.06 w/o boron may be used.

When making this alloy the elements must be carefully balanced according to both Equation 1 (Eq. 1) and Equation 2 (Eq. 2) to ensure acceptable resistance to chloride SCC:

$$W/o\ \mathrm{Ni} + 2(w/o\ \mathrm{Cu}) \leq \frac{W/o\ \mathrm{Cr} + w/o\ \mathrm{Mo} - 14.6}{1.5} \quad \text{(Eq. 1)}$$

$$w/o\ \mathrm{Mn} < w/o\ \mathrm{Cr} + w/o\ \mathrm{Mo} \quad \text{(Eq. 2)}$$

Acceptable chloride SCC resistance for the present alloy is defined here and throughout this application as meaning that the alloy, when tested at about 50% of the alloy's room temperature 0.2% yield strength, but not less than about 60 ksi, does not fracture because of stress corrosion cracking in less than about 400 hours in boiling, saturated, aqueous sodium chloride solution containing about 2.5 w/o ammonium bisulfite intended to simulate drilling fluid. After 1000 h in the test medium without fracture, the test specimens are removed and evaluated for best SCC resistance. To that end, the 1000 h specimens are optically examined for any indication of cracks under 20X magnification. Suspicious areas are examined at 1000X magnification. The analyses of those examples thus examined after 1000h which show no cracks are most preferred.

Additionally, when making this alloy the elements must be carefully balanced to ensure that the wrought alloy is essentially ferrite-free, that is, having less than about 0.5 volume percent (v/o), better yet less than about 0.1 v/o, and preferably having no more than a trace of ferrite as determined by the point intercept method. For best results, no ferrite is detectable in the wrought alloy.

This alloy is readily prepared by means of conventional, well-known techniques including powder metallurgy. preferably, for best results, electric arc melting followed by argon-oxygen decarburization (AOD) and then electroslag remelting (ESR) for further alloy refinement is used. After remelting, as by ESR, the ingot is homogenized at about 2200F. (about 1200C.) for about 16–48h. The alloy is warm-worked, usually by forging, at a temperature of about 1350–1650F. (about 730–900C.) sufficiently to attain desired properties, and then quenched, as in water, but not subsequently annealed.

It has been found that the present alloy and articles made therefrom, when warm-worked using conventional techniques, but not subsequently annealed, exhibit an outstanding combination of properties including non-magnetic behavior, high yield strength, and good corrosion resistance, particularly resistance to chloride stress corrosion cracking. More particularly, the present alloy and articles made therefrom, when warm-worked but not subsequently annealed, are essentially ferrite-free and have a relative magnetic permeability of less than about 1.02, a room temperature 0.2% offset yield strength of at least about 100 ksi, and, when tested under a stress of about 50% of yield strength, but not less than about 60 ksi, do not fracture because of stress corrosion cracking in less than about 400h in boiling, saturated, aqueous sodium chloride solution containing about 2.5 w/o ammonium bisulfite. The alloy may be produced in various forms including billet, bar, rod, wire, plate, sheet, and strip. Additionally, the alloy lends itself to use in the fabrication of articles of manufacture, including drill collars and housings for containing measurement-while-drilling equipment used in the directional drilling of oil and gas wells. A drill collar is made from a bar prepared as described hereinabove. The bar is trepanned to form an internal bore to desired dimensions. Following trepanning, at least the interior surface is treated so as to place it into compression, for example as by burnishing or peening.

EXAMPLES

The numbered Examples (Ex. 1–7) set forth in Table III are exemplary of the present invention. The lettered Heats (Hts. A-M) listed in Table III are outside the scope of the present invention and are included for comparative purposes only. In addition to the amounts of each element listed, boron was added to the production-sized Examples and Heats, in the amounts indicated in the footnote to Table III, to improve hot workability. Boron was not purposely added to the smaller Examples and Heats. With respect to both the Examples and the Heats, the balance (bal.) was iron except for incidental impurities which included up to about 0.05 w/o phosphorus and up to about 0.03 w/o sulfur.

Examples 1 and 2, having the compositions shown in Table III, were prepared from a 36,000 lb (about 16,360 kg) production heat which had been electric arc melted, argon-oxygen decarburized (AOD) and continuously cast into 9.75 in (about 24.8 cm) rd electrodes, having a nominal composition of about 0.04 w/o max. carbon, 17 w/o manganese, 0.5 w/o max. silicon, 17 w/o chromium, 1 w/o molydenum, 0.5 w/o nitrogen, and 1.2 w/o max. 1.2 w/o max. ni+2Cu, the balance iron, and having a specific composition of about 0.038 w/o carbon, 17.64 w/o manganese, 0.46 w/o silicon, 0.020 w/o phosphorus, 0.003 w/o sulfur, 17.54 w/o chromium, 0.93 w/o nickel, 1.06 w/o molybdenum, 0.05 w/o copper, 0.51 w/o nitrogen, and 0.0023 w/o boron.

Several electrodes were electroslag remelted (ESR) into a 17 in (about 43 cm) rd ingot, which was then homogenized at about 2200F. (about 1200C.) for about 34 h. The ingot was rotary forged to intermediate size at about 2200F. (about 1200C.), then warm-worked, after cooling to about 1400F. (about 760C.), to a 9 in (about 23 cm) rd bar, and then water quenched. After trimming the ends, specimens of Examples 1 and 2, having the compositions shown in Table III, were taken from the A end and the X end of the forged bar respectively.

Examples 3–7, the compositions of which are listed in Table III, were each prepared from an approximately 17*lb*. (about 7.7 kg) experimental heat which was induction melted under argon and cast into a 2¾ in (about 7.0 cm) sq ingot. The ingot was forged to a 2¼×⅞ in (about 5.7 cm×2.2 cm) bar from about 2200F. (1200C.). A portion of each bar was hot worked from about 2200F. (about 1200C.) to a ¾ in (about 1.9 cm) sq bar, cut in half, reheated, and forged, in the warm-working temperature range (approximately 1350–1650F. (about 730–900C.)), to a ⅝ in (about 1.6 cm) sq bar.

Comparative Heats A-E, I, K-M were melted and processed as described in connection with Exs. 3–7. Heats F and G were processed by warm-working as described for Exs. 1 and 2 and finished to 7¾ in (about 19.7 cm) O.D. and 6½ in (about 16.5 cm) O.D. drill collars respectively. Heat H was warm-worked by rotary forge to a 8½ in (21.6 cm) rd bar. Heat J was warm-worked on a foregoing press and finished to an 8 in (about 20.3 cm) O.D. drill collar.

Tensile specimens were obtained from each Example and Heat. The results from room temperature (R.T.) tensile tests are shown in Table IV, including 0.2% offset yield strength (0.2% Y.S.) and ultimate tensile strength (U.T.S.), both given in thousands of pounds per square inch (ksi) and in megaPascals (MPa), as well as the percent elongation (% El.) and the percent reduction in cross-sectional area (% R.A.). Table IV also shows the relative magnetic permeability and SCC tensile fracture time in hours (h) for each Example and Heat.

TABLE III

| Ex/Ht No. | w/o C | Mn | Si | Cr | Ni | Mo | Cu | N | Ni + 2Cu | Cr + Mo | Cr + Mo − 14.6 / 1.5 | Fe |
|---|---|---|---|---|---|---|---|---|---|---|---|---|
| 1* | 0.052 | 17.46 | 0.45 | 17.56 | 0.99 | 1.06 | 0.06 | 0.48 | 1.11 | 18.62 | 2.68 | Bal. |
| 2* | 0.049 | 17.38 | 0.48 | 17.42 | 0.99 | 1.04 | 0.06 | 0.50 | 1.11 | 18.46 | 2.57 | Bal. |
| 3 | 0.036 | 15.13 | 0.39 | 14.79 | 0.23 | 1.48 | 0.24 | 0.31 | 0.71 | 16.27 | 1.11 | Bal. |
| 4 | 0.021 | 14.89 | 0.41 | 15.09 | <0.01 | 0.98 | <0.01 | 0.35 | <0.01 | 16.07 | 0.98 | Bal. |
| 5 | 0.024 | 14.93 | 0.43 | 13.92 | <0.01 | 1.92 | <0.01 | 0.35 | <0.01 | 15.84 | 0.83 | Bal. |
| 6 | 0.039 | 14.74 | 0.37 | 14.74 | <0.01 | 1.50 | <0.01 | 0.31 | <0.01 | 16.24 | 1.09 | Bal. |
| 7 | 0.037 | 14.79 | 0.40 | 14.79 | 0.50 | 1.52 | 0.24 | 0.32 | 0.98 | 16.31 | 1.14 | Bal. |
| A | 0.026 | 15.02 | 0.39 | 15.98 | 0.02 | 0.98 | 0.98 | 0.38 | 1.98 | 16.96 | 1.57 | Bal. |
| B | 0.026 | 14.83 | 0.40 | 15.87 | 0.99 | 1.94 | <0.01 | 0.36 | <1.00 | 17.81 | 2.14 | Bal. |
| C | 0.039 | 15.32 | 0.39 | 14.75 | 0.24 | 1.52 | 0.49 | 0.32 | 1.22 | 16.27 | 1.11 | Bal. |
| D | 0.042 | 15.25 | 0.38 | 14.87 | 0.50 | 1.50 | 0.50 | 0.32 | 1.50 | 16.37 | 1.18 | Bal. |
| E | 0.028 | 17.92 | 0.39 | 15.95 | <0.01 | 1.96 | <0.01 | 0.38 | <0.01 | 17.91 | 2.21 | Bal. |
| F | 0.036 | 14.84 | 0.53 | 16.21 | 1.01 | 0.94 | 0.54 | 0.40 | 2.09 | 17.15 | 1.70 | Bal. |
| G | 0.034 | 14.80 | 0.54 | 16.20 | 1.11 | 0.96 | 0.57 | 0.40 | 2.25 | 17.16 | 1.71 | Bal. |
| H* | 0.031 | 15.12 | 0.47 | 16.34 | 0.95 | 0.92 | 0.56 | 0.40 | 2.07 | 17.26 | 1.77 | Bal. |
| I | 0.030 | 15.32 | 0.44 | 15.67 | 1.02 | 0.96 | 0.50 | 0.37 | 2.02 | 16.63 | 1.35 | Bal. |
| J | 0.117 | 17.78 | 0.46 | 17.54 | 0.42 | 0.95 | 0.98 | 0.46 | 2.38 | 18.49 | 2.59 | Bal. |
| K | 0.108 | 17.85 | 0.46 | 17.85 | 0.32 | 0.95 | 0.97 | 0.48 | 2.26 | 18.80 | 2.80 | Bal. |
| L | 0.040 | 14.83 | 0.40 | 17.50 | 0.38 | 0.36 | 0.33 | 0.44 | 1.04 | 17.86 | 2.17 | Bal. |
| M | 0.038 | 17.36 | 0.38 | 14.77 | <0.01 | 1.52 | <0.01 | 0.36 | <0.01 | 16.29 | 1.13 | Bal. |

*The following quantities of boron were present:
Ex. 1, 0.0023 w/o; Ex. 2, 0.0023 w/o;
Ex. H, 0.0028 w/o.

TABLE IV

| Ex/Ht | 0.2% Y.S. ksi (MPa) | U.T.S. ksi (MPa) | % El. | % R.A. | Mag.[1] Perm. | SCC[2] Tensile (h) |
|---|---|---|---|---|---|---|
| 1 | 117.4(809.5) | 139.3(960.5) | 41.4 | 70.2 | <1.02 | 843 |
| | 118.8(819.1) | 139.8(963.9) | 39.9 | 69.9 | | |
| 2 | 129.9(859.6) | 148.0(1020.5) | 42.5 | 73.8 | <1.02 | 1000-NF*[3] |
| | 131.0(903.2) | 150.2(1035.6) | 40.0 | 72.6 | | |
| 3 | 126.4(871.5) | 148.7(1025.3) | 34.2 | 71.1 | <1.02 | 594 |
| | | | | | | 407 |
| 4 | 126.5(872.2) | 146.7(1011.5) | 29.5 | 68.5 | <1.02 | 557[4] |
| | | | | | | 1000-NF |
| 5 | 112.2(773.6) | 141.5(975.7) | 42.9 | 73.3 | <1.02 | 1000-NF[4] |
| | | | | | | 1000-NF |
| 6 | 129.5(892.9) | 151.5(1044.6) | 32.3 | 68.4 | <1.02 | 1000-NF[4] |
| | | | | | | 1000-NF |
| 7 | 130.2(897.7) | 149.1(1028.0) | 32.6 | 71.0 | <1.02 | 880 |
| | | | | | | 1000-NF |
| A | 140.7(970.1) | 156.9(1081.8) | 28.7 | 68.5 | <1.02 | 53 |
| | | | | | | 47 |

TABLE IV-continued

| Ex/Ht | 0.2% Y.S. ksi (MPa) | U.T.S. ksi (MPa) | % El. | % R.A. | Mag.[1] Perm. | SCC[2] Tensile (h) |
|---|---|---|---|---|---|---|
| B | 124.2(856.3) | 148.7(1025.3) | 29.2 | 58.5 | >1.02 | 656 |
| | | | | | <1.05 | 565 |
| C | 118.4(816.3) | 142.3(981.1) | 35.0 | 67.9 | <1.02 | 213 |
| | | | | | | 202 |
| D | 119.2(821.9) | 143.9(992.2) | 40.3 | 70.4 | <1.02 | 57 |
| | | | | | | 93 |
| E | 144.0(992.8) | 160.2(1104.5) | 20.7 | 36.2 | >1.1 | 87 |
| | | | | | <1.2 | 1000-NF |
| F | 105.7(728.8) | 130.2(897.7) | 45.4 | 72.4 | <1.02 | 213* |
| | 113.1(779.8) | 135.5(934.3) | 42.2 | 73.3 | | |
| G | 100.3(691.6) | 129.6(893.6) | 45.3 | 71.1 | <1.02 | 170* |
| | | 126.2(870.2) | 44.9 | 70.9 | | |
| H | 122.6(845.3) | 143.1(986.7) | 40.3 | 72.5 | — | 263 |
| | 121.2(835.7) | 142.1(974.8) | 40.0 | 74.6 | | 67 |
| I | 132.1(910.8) | 143.9(992.2) | 40.3 | 70.4 | <1.02 | 17 |
| | | | | | | 157 |
| J | 132.3(912.2) | 154.9(1068.0) | 35.8 | 60.6 | — | 39 |
| | 128.9(888.8) | 152.5(1051.4) | 33.7 | 59.6 | | 98 |
| K | 154.1(1062.3) | 170.0(1172.1) | 27.0 | 59.9 | <1.02 | 926-NF |
| | | | | | | 814 |
| L | 128.8(888.0) | 150.9(1040.4) | 30.4 | 69.5 | <1.02 | 980 |
| | | | | | | 131 |
| M | 129.2(890.9) | 151.7(1046.0) | 35.0 | 67.9 | <1.02 | 382[4] |
| | | | | | | 1096-NF |

[1]Measured in wrought condition.
[2]SCC tensile specimens were stressed to about 50% of 0.2% offset yield strength, rounded off to the nearest 5 ksi, unless marked with an asterisk (*).
*Specimen stressed at about 60 ksi.
[3]NF-No fracture in time indicated.
[4]Ex. 4-6 and Ht. M were stressed to 125 ksi.

Tensile specimens of Exs. 1 and 2 were obtained from about lin (about 2.54 cm) below the surface of the forged bar, while tensile specimens of Exs. 3-7 and Hts. A-E, I, K-M were machined from the forged ⅝ in (about 1.6 cm) sq bar. Tensile specimens of Hts. F-H, and J were cut from about lin (about 2.54 cm) below the surface of each forged drill collar or bar. The tensile specimens of Exs. 1 and 2, and Hts. F-H and J, were machined to a 0.505 in (about 1.28 cm) gage diameter, while all other tensile specimens were machined to a 0.252 in (about 0.64 cm) gage diameter. As shown in Table IV, all examples of the present invention exceeded 100 ksi for room temperature 0.2% offset yield strength required by the American Petroleum Institute (API) for drill collar steels.

Disc-shaped specimens were obtained from each Example and Heat in the wrought condition, and tested for relative magnetic permeability using a Severn Gage. As shown in Table IV, all examples of the present invention exhibited a relative magnetic permeability of less than 1.02 in the wrought condition, indicating acceptable non-magnetic behavior.

To test SCC resistance, SCC tensile specimens were obtained from approximately the same location of each Example or Heat as described above for the mechanical tensile tests. The specimens were then machined according to NACE standard TM 0177, and tested in a modified test environment consisting of boiling, saturated, aqueous sodium chloride solution containing about 2.5 w/o ammonium bisulfite to simulate the effect of drilling fluid. Each specimen was stressed to about 50% of its yield strength, but not at less than about 60 ksi, with the exception of Exs. 4-6 and Ht. M, which were stressed to about 125 ksi.

As may be seen in Table IV, all examples of the present invention (Ex. 1-7) meet the requirement that specimens do not fracture because of stress corrosion cracking in less than 400h under the above-described conditions. Exs. 4-6 further demonstrate the benefit of very low Ni+2Cu (<0.01) by exceeding the 400 h requirement at over double the minimum required stress level of 60 ksi.

Ht. A illustrates the deleterious effect of nickel and copper on the SCC resistance of chromium-manganese stainless steels when not sufficiently counterbalanced by chromium and molybdenum, Cr and Mo being lower in this heat than required by Eq. 1:

$$W/o\ \mathrm{Ni} + 2(w/o\ \mathrm{Cu}) \leq \frac{W/o\ \mathrm{Cr} + w/o\ \mathrm{Mo} - 14.6}{1.5} \quad \text{(Eq. 1)}$$

Ht. B also illustrates the importance of carefully counterbalancing the deleterious effect on SCC resistance of nickel and copper with sufficient amounts of chromium and molybdenum in order to maintain acceptable SCC resistance in the alloy. Ht. B differs compositionally from Ht. A in that Ht. B contains proportionately more chromium plus molybdenum and has low Ni+2Cu, as required by Eq. 1. The dramatic effect of this compositional difference on SCC resistance is evident by comparison of the SCC fracture times of Ht. A (53 and 47 h) and Ht. B (656 and 565h). Note that while illustrating the benefits of high chromium plus molybdenum and low Ni+2Cu, Ht. B contains more ferrite and therefore exhibits a higher magnetic behavior than acceptable for non-magnetic drill collars. Heat L illustrates the need for sufficient molybdenum in the alloy to achieve the desired level of SCC resistance. Thus, although balanced relative to Ni+2Cu and to manganese according to Eqs. 1 and 2, Heat L exhibits erratic SCC tensile results because it contains too little molybdenum.

Comparison of Ex.7 with Hts. C and D further illustrates the especially deleterious effect of high copper content on SCC resistance. Ex. 7, which, while compositionally similar, contains only about half the amount of copper as in Hts. C and D, exhibits good SCC resistance while the latter heats do not.

Although not balanced to suppress ferrite formation, and thus exhibiting some magnetic activity, Ht. E illustrates the need to balance the manganese content of the present alloy according to Eq: 2:

$$\text{w/o Mn} < \text{w/o Cr} + \text{w/o Mo} \qquad \text{(eq. 2)}$$

Because Ht. E contains a high proportion of manganese relative to Cr+Mo, the SCC tensile results were somewhat erratic: one specimen failed in a short time while the other specimen did not fail after 1000 h. The need to balance the alloy according to Eq. 2 is further illustrated by Ht. M. Although having an exceedingly low Ni+2Cu content (<0.01), which tends to impart to the alloy a high level of SCC resistance (as illustrated by Hts. 4–6), Ht. M exhibited erratic SCC resistance due to the high manganese content relative to the amount of chromium plus molybdenum.

The SCC test results indicate that the present alloy has superior SCC resistance when compared with UNS S28200 (Ht. J) and UNS S21300 (Hts. F-I), which fractured in less than 400h. The poor performance of Ht. J is attributable to grain boundary sensitization due to carbide precipitation upon warm-working in the mill and illustrates the need to limit carbon to avoid SCC when processing workpieces having a large cross-section. Though having a similarly high level of carbon, Ex. K, a laboratory heat, did not become sensitized during warm-working, as is reflected by its fracture times, because the small size of the laboratory-processed material resulted in faster cooling and hence no sensitization.

The terms and expressions which have been employed herein are used as terms of description and not of limitation. There is no intention in the use of such terms and expressions to exclude any equivalents of the features described or any portions thereof. It is recognized, however, that various modifications are possible within the scope of the invention claimed.

We claim:

1. An austenitic, nonmagnetic, stainless steel alloy, providing high yield strength and good stress corrosion cracking resistance in high chloride concentration environments, consisting essentially of, in weight percent, about

| | w/o |
|---|---|
| C | 0.08 max. |
| Mn | 14–19 |
| Si | 1 max. |
| Cr | 12–21 |
| Ni | 3.5 max. |
| Mo | 0.5–4 |
| Cu | 2.0 max. |
| N | 0.2–0.8 |

the balance essentially iron; wherein $$\text{w/o } Ni + 2(\text{w/o Cu}) \leqq \frac{\text{w/o } Cr + \text{w/o Mo} - 14.6}{1.5};$$

w/o Mn<w/o Cr+w/o Mo; and said alloy being essentially ferrite-free.

2. An alloy as recited in claim 1 containing no more than about 0.05 w/o C.

3. An alloy as recited in claim 2 containing about 15–18 w/o Mn.

4. An alloy as recited in claim 3 containing about 14–19.5 w/o Cr.

5. An alloy as recited in claim 4 containing about 0.75–2.5 w/o Mo.

6. An alloy as recited in claim 5 containing about 0.3–0.7 w/o N.

7. An alloy as recited in claim 6 containing about

| | w/o |
|---|---|
| Si | 1 max. |
| Ni | 2.5 max. |
| Cu | 1.5 max. |

8. An alloy as recited in claim 7 containing no more than about 0.035 w/o C.

9. An alloy as recited in claim 8 containing at least about 16 w/o Mn.

10. An alloy as recited in claim 9 containing about 16–18 w/o Cr.

11. An alloy as recited in claim 10 containing about 1.0–2.0 w/o Mo.

12. An alloy as recited in claim 11 containing about 0.4–0.6 w/o N.

13. An alloy as recited in claim 12 containing about

| | w/o |
|---|---|
| Si | 0.75 max. |
| Ni | 1.0 max. |
| Cu | 0.3 max. |

14. An alloy as recited in claim 1, wherein said alloy, when significantly warm worked but not subsequently annealed, has a relative magnetic permeability of less than about 1.02, has a room temperature 0.2% offset yield strength of at least about 100 ksi, and, when tested at about 50% of said alloy's yield strength, but not at less than about 60 ksi, does not fracture because of stress corrosion cracking in less than about 400 hours in boiling, saturated, aqueous sodium chloride solution containing about 2.5 w/o ammonium bisulfite.

15. An alloy as recited in claim 13, wherein said alloy, when significantly warm worked but not subsequently annealed, has a relative magnetic permeability of less than about 1.02, has a room temperature 0.2% offset yield strength of at least about 100 ksi, and, when tested at about 50% of said alloy's yield strength, but not at less than about 60 ksi, does not fracture because of stress corrosion cracking in less than about 400 hours in boiling, saturated, aqueous sodium chloride solution containing about 2.5 w/o ammonium bisulfite.

16. An austenitic, nonmagnetic, stainless steel alloy, providing high yield strength and good stress corrosion cracking resistance in high chloride concentration environments, consisting essentially of, in weight percent, about:

| | w/o |
|---|---|
| C | 0.05 max. |
| Mn | 17 |
| Si | 0.5 max. |
| Cr | 17 |
| Ni + Cu | 1.2 max. |
| Mo | 1 |

-continued

| | w/o |
|---|---|
| N | 0.5 |

the balance essentially iron, said alloy being essentially ferrite-free.

17. An alloy as recited in claim 16, wherein said alloy, when significantly warm worked but not subsequently annealed, has a relative magnetic permeability of less than about 1.02, has a room temperature 0.2% offset yield strength of at least about 100 ksi, and, when tested at about 50% of said alloy's yield strength, but not at less than about 60 ksi, does not fracture because of stress corrosion cracking in less than about 400 hours in boiling, saturated, aqueous sodium chloride solution containing about 2.5 w/o ammonium bisulfite.

18. An alloy as recited in claim 1 containing at least about 15 w/o Mn.

19. An alloy as recited in claim 1 containing at least about 0.75 w/o max. Si.

20. An alloy as recited in claim 1 containing at least about 16 w/o Mn.

21. An alloy as recited in claim 20 containing about 0.75 w/o max. Si.

22. An alloy as recited in claim 20 containing about 0.5 w/o max. Si.

* * * * *

UNITED STATES PATENT AND TRADEMARK OFFICE

CERTIFICATE OF CORRECTION

PATENT NO. : 5,094,812

DATED : March 10, 1992

INVENTOR(S) : DULMAINE, KOSA, MAGEE, JR., and SCHLOSSER

It is certified that error appears in the above-identified patent and that said Letters Patent is hereby corrected as shown below:

Column 5:
Line 65, "1000" should read -->1000--.

Column 6:
Line 13, "preferably" should read --Preferably--.

Column 8:
Table IV, Ex. 2 under the column headed "0.2% Y.S.", "(859.6)" should read --(895.6)--.

Column 11:
Line 8, "(eq. 2)" should read --(Eq. 2)--.

Column 12:
Claim 16, line 11, "Ni + Cu" should read --Ni + 2Cu--.

Signed and Sealed this

Nineteenth Day of October, 1993

*Attest:*

*Attesting Officer*

BRUCE LEHMAN

*Commissioner of Patents and Trademarks*